United States Patent [19]

Herngvist

[11] Patent Number: 5,001,389

[45] Date of Patent: Mar. 19, 1991

[54] CATHODE-RAY TUBE HAVING ARC SUPPRESSING MEANS THEREIN

[75] Inventor: Karl G. Herngvist, Princeton, N.J.

[73] Assignee: RCA Licensing Corporation, Princeton, N.J.

[21] Appl. No.: 354,588

[22] Filed: May 22, 1989

[51] Int. Cl.[5] ..... H01J 29/82

[52] U.S. Cl. ..... 313/417; 313/456; 313/482

[58] Field of Search ..... 313/456, 482, 417, 479, 313/414

[56] References Cited

U.S. PATENT DOCUMENTS 2,375,815 5/1945 Ohl ..... 313/456

4,061,943 12/1977 DiDominico et al. ..... 313/482

*Primary Examiner*—Palmer C. DeMeo

*Attorney, Agent, or Firm*—Joseph S. Tripoli; Dennis H. Irlbeck

[57] ABSTRACT

The present invention provides an improved cathode-ray tube. The neck of the tube envelope is closed at one end by a stem that includes a plurality of electrically conductive pins extending therethrough. The pins are interconnected to various electrodes of the gun by electrical leads that are welded to respective pins. The improvement comprises at least one of the leads having a bend therein that positions a nonwelded portion of the lead between a lead-to-pin weld location and the neck of the tube.

1 Claim, 3 Drawing Sheets

10
12
14
16
18
20
22
24
26
28
30
P
P

CATHODE-RAY TUBE HAVING ARC SUPPRESSING MEANS THEREIN

This invention relates to a cathode-ray tube having means for suppressing arcing therein, and particularly to an improved connection between electrically conductive leads and stem pins in a cathode-ray tube.

BACKGROUND OF THE INVENTION

A cathode-ray tube comprises an evacuated glass envelope including a viewing window, which carries a luminescent viewing screen, and a glass neck, which houses an electron gun mount assembly for producing one or more electron beams for selectively scanning the viewing screen. Each gun of the mount comprises a cathode and a plurality of electrodes supported as a unit in spaced tandem relation from at least two elongated, axially-oriented support rods, which are usually in the form of glass beads. An end of the neck is closed with a glass stem through which a plurality of conductive metal pins extend. The pins are connected to the various electrodes by either conductive wires or ribbons called leads.

The beads have extended surfaces closely spaced from and facing the inner surface of the glass neck. The beads usually extend from the region close to the stem, where the ambient electric fields are small, to the region of the electrode to which the highest operating potential is applied, where the ambient electric fields are high during the operation of the tube. The spaces between the beads and the neck surfaces are channels in which leakage currents may travel from the stem region up to the region of the highest-potential electrode. These leakage currents are associated with blue glow in the neck glass, with charging of the neck surface and with arcing or flashover in the neck. The driving field for these currents is the longitudinal component of the electric field in the channel. As high voltages are applied to a gun, the potential of the neck glass begins to rise slowly during charging of stray capacitances by the currents flowing through the high resistance of the neck glass. This resistance is a combination of surface resistance and bulk resistance of the neck glass. This bulk resistance decreases as the neck glass warms up. Thus, an electric field develops between the gun parts and the neck glass which can lead to field emission to the neck glass, development of electron avalanches and, finally, arcing.

Several expedients have been suggested for blocking or reducing the leakage currents. Coatings on the neck glass are partially effective to prevent arcing, but are burned through when arcing does occur. A metal wire or ribbon in the channel (partially or completely surrounding the mount assembly) is also only partially effective to reduce arcing, because the wire or ribbon is often bypassed because of its limited longitudinal extent, because the limited space between the bead and the neck may result in shorting problems, and because there is frequently field emission from the metal structure.

Another solution to the arcing problem is suggested in U.S. Pat. No. 4,288,719, issued to K. G. Hernqvist on Sept. 8, 1981. This patent discloses a cathode-ray tube having an electron gun wherein each bead has an electrically-conducting area, such as a metal coating on the surface thereof facing the neck. The conducting areas may be electrically floating, which is preferred, or connected to an electrode of the mount assembly or to a fixed voltage. The purpose of the metallized bead is to prevent electron avalanches, thereby suppressing arcing.

Rather than rely on means to prevent electron avalanches, it is a purpose of the present invention to locate the sources of field emission that provide the original electrons and to modify the tube structure to prevent these electrons from reaching the tube neck.

SUMMARY OF THE INVENTION

The present invention provides an improved cathode-ray tube, wherein the neck of the envelope is closed at one end by a stem that includes a plurality of electrically conductive pins extending therethrough. The pins are interconnected to various electrodes of the gun by electrical leads that are welded to respective pins. The improvement comprises at least one of the leads having a bend therein that positions a nonwelded portion of the lead between a lead-to-pin weld location and the neck of the tube.

DESCRIPTION OF THE PREFERRED EMBODIMENTS

Figure 1:
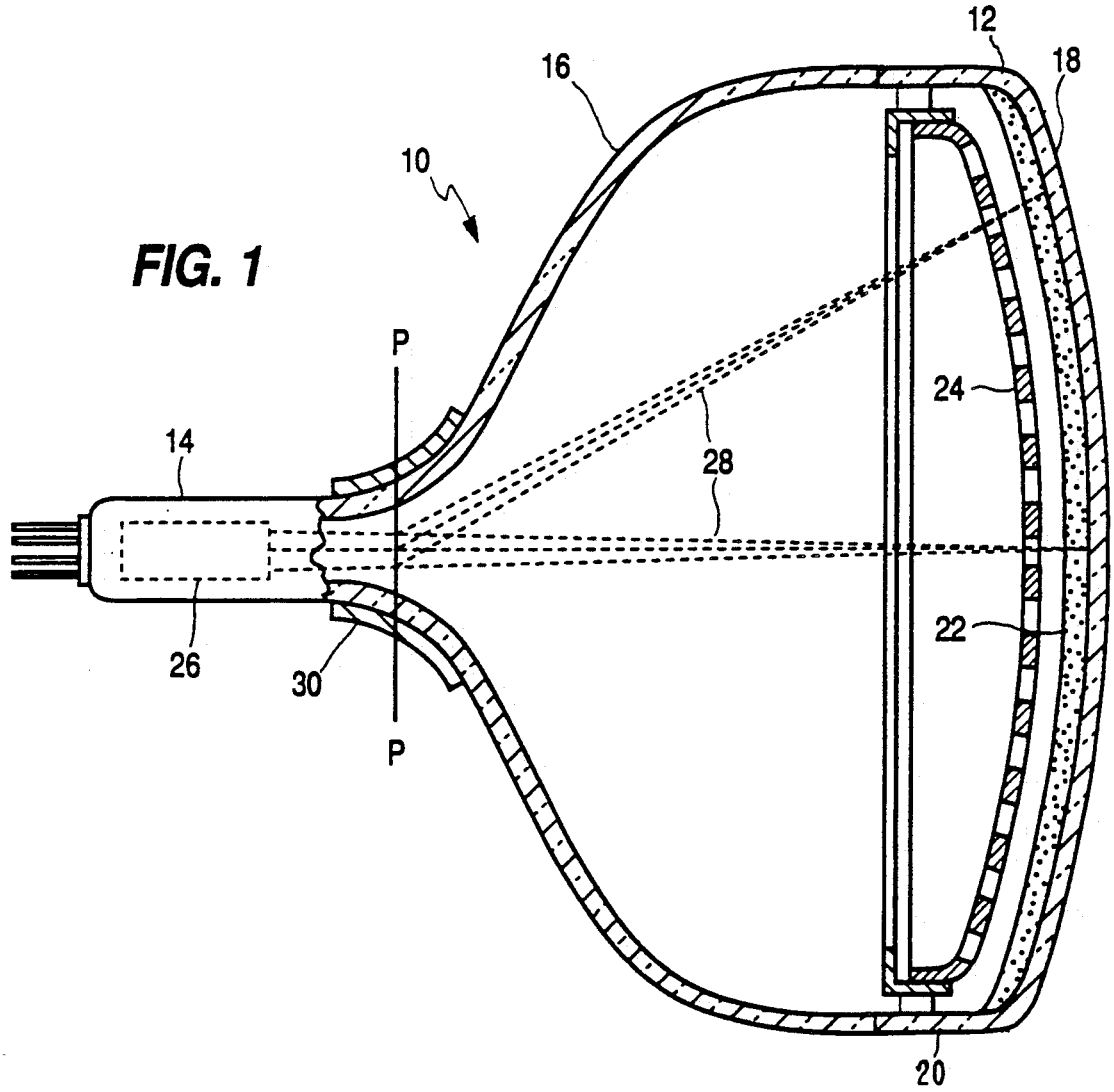
FIG. 1 is a plan view, partly in axial section, of a shadow mask color picture.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen 22 is preferably a line screen, with the phosphor lines extending substantially perpendicular to the high frequency raster line scan of the tube (i.e., normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14, to generate and direct three electron beams 28 along initially coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to both vertical and horizontal magnetic flux which cause the beams to scan horizontally and vertically, respectively, in a rectangular raster over the screen 22. The initial plane of deflection (at zero deflection) is shown by the line P—P in FIG. 1, at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
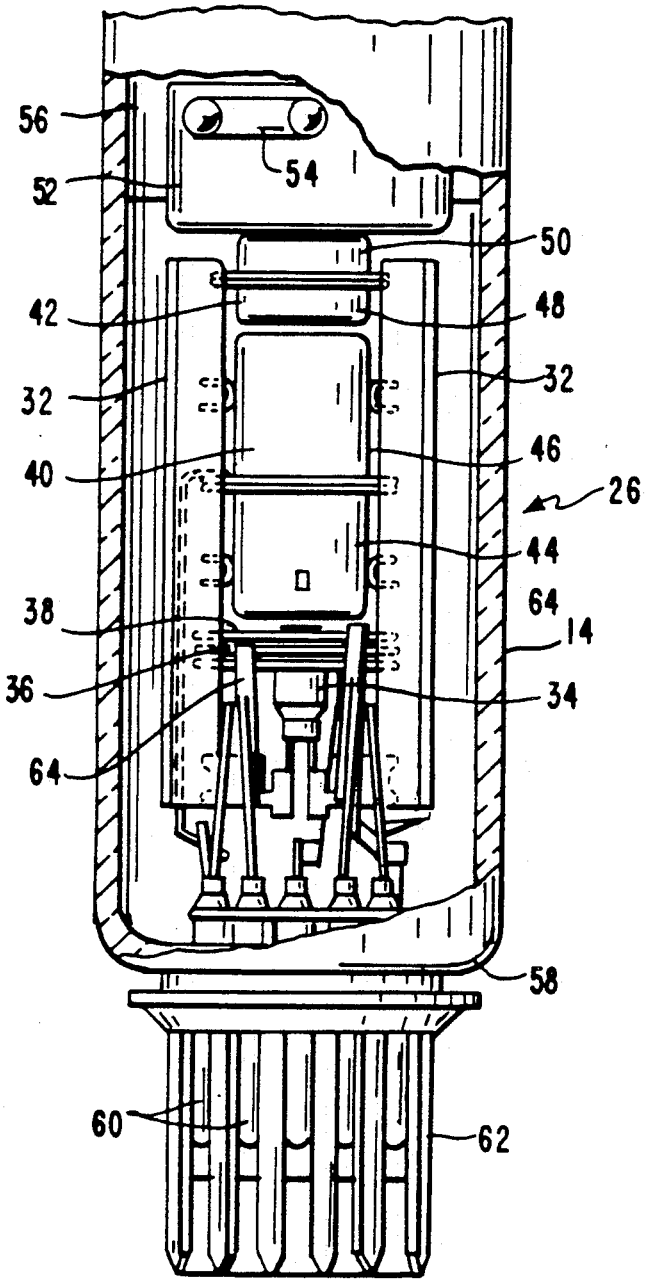
FIG. 2 PRIOR ART
FIG. 2 is a partial axial section view of the electron gun shown in dashed lines in FIG. 1.

The details of the electron gun 26 are shown in FIG. 2. The gun 26 comprises two glass support rods 32 to which the various electrodes are attached or mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with two cup-shaped elements 44 and 46. The open ends of these elements, 44 and 46, are attached to each other. The G4 electrode 42 also is formed with two smaller cup-shaped elements 48 and 50 which are attached to each other at their open ends. A shield cup 52 is attached to the element 50 at one end of the gun 26. Snubbers 54 are attached to the shield cup 52, to center the gun 26 in the neck 14, and to contact an internal conductive coating 56 in the tube to provide an anode voltage to the gun 26.

The neck 14 of the tube 10 is closed at one of its ends by a disk-shaped glass stem 58. The stem 58 includes a plurality of electrically conductive pins 60 that extend therethrough. Outside the tube envelope, the pins 60 are held by an insulative base 62. Inside the tube envelope, the pins 60 are interconnected to the various electrodes by leads 64 which are usually conductive wires or ribbons. As can be seen in FIG. 2, the lengths of the portions of the pins 60 inside the tube envelope differ from each other, with the lengths depending on where connection to a lead 64 is made.

Figure 3:
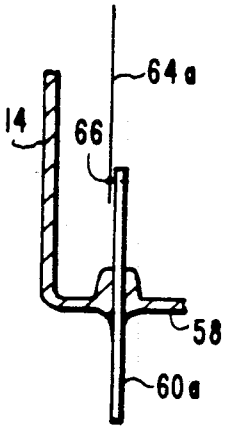
FIG. 3 PRIOR ART
FIGS. 3, 4 and 5 are partly sectioned views of three prior art embodiments of electrical leads welded to stem pins.
Figure 4:
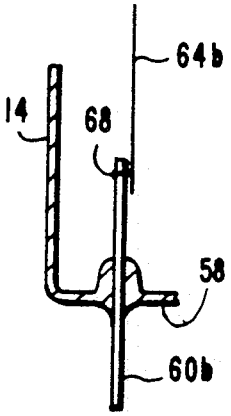
FIG. 4 PRIOR ART
Figure 5:
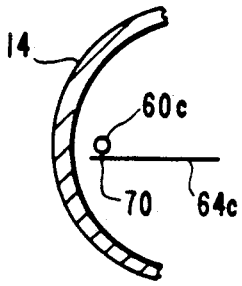
FIG. 5 PRIOR ART

The connections of the leads 64 to the pins 60, are usually of three different types. These three types of connections are illustrated in isolated detail in FIGS. 3, 4 and 5. In FIG. 3, a lead 64*a* is welded to a pin 60*a* at a point 66, with the lead 64*a* located between the pin 60*a* and the neck 14. In FIG. 4, a lead 64*b* is welded to a pin 60*b* at a point 68, with the pin 60*b* being closer to the neck 14. In FIG. 5, a lead 64*c* is tangentially welded to a pin 60*c* at a point 70, with a cut-off tip of the lead 64*c* extending toward the neck 14.

To determine the field emission sources of the electrons that lead to arcing, tests were performed on several tubes, including a tube having an electron gun as described with respect to FIG. 2.

To measure the field emitting properties of the electron gun, the gun was inserted into a neck having a conductive, transparent internal coating of tin oxide. A high positive potential was applied to the coating, and the currents to the different gun electrodes were measured. When current was emitted from the electrodes or leads, a blue fluorescence was observed at the neck. Since the coating was transparent, the approximate origin of the emission center could be located.

To simulate the condition for a processed cathode-ray tube, the tube was baked at 350° C. for 1 hour. Then, the cathodes were activated. The voltage necessary to draw 2μA emission current for the different electrodes was recorded. An adequately stable emission was obtained at this current level. There was no change in the total emission with the cathode heaters on or off. Therefore, the data was taken with no heater power.

Visual observations of the electron impact spots at the neck glass indicated that most emission originated from areas where the leads were welded to the stem pins. Emission also occurred where sharp wires and ribbons pointed directly at the neck glass.

As a result of these tests, it was determined that the emission points, such as the weld points between the leads 64 and the pins 60 and the lead tips should be shielded from the inside surface of the tube neck 14. The simplest and most economical way of providing this shielding is to use the leads themselves to shield the weld points. In the preferred embodiments, the leads, which preferably are conductive ribbons, are contoured so that nonwelded portions of the leads are located between the weld points to the pins and the closest inside surface of the tube neck.

Figure 6:
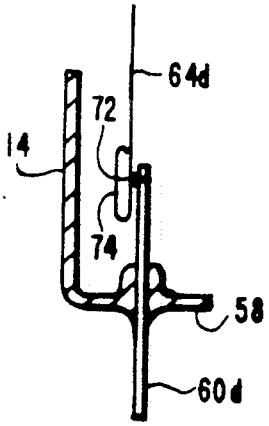
FIGS. 6, 7 and 8 are partly sectioned views of three improved embodiments of electrical leads welded to stem pins.

A first preferred embodiment is shown in FIG. 6. In this embodiment, a lead 64*d*, that is welded to a pin 60*d* at a point 72, includes a loop back over the weld point 72, so that an unwelded portion 74 of the lead 64*d* is located between the weld point 72 and the neck 14. The tip of the portion 74 is bent inwardly, toward the welded portion of the lead 64*d*, so that it will not act as an electron emission source.

Figure 7:
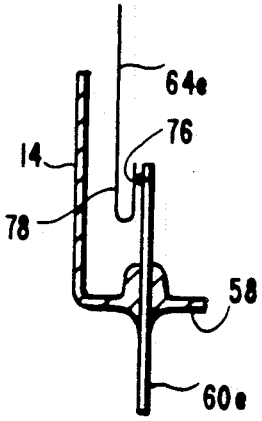

A second preferred embodiment is shown in FIG. 7. In this embodiment, a lead 64*e* is looped back along itself and is welded at a point 76, near its end, to a pin 60*e*. A portion 78 of the lead 64*e* coming from an electrode is located between the weld point 76 and the neck 14.

Figure 8:
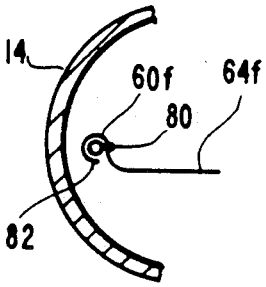

A third embodiment is shown in FIG. 8. In this embodiment, a lead 64*f* is wrapped around a pin 60*f*, so that a tip of the lead 64*f* points back toward itself, away from the neck 14. The lead 64*f* is welded to the pin 60*f* at a point 80 on the side of the pin 60*f* opposite the neck 14. In this embodiment, a portion 82 of the lead 64*f* is located between the weld point 80 and the neck 14.

Tests were performed on seven electron guns to determine if the novel electron guns, having bent leads at the lead-to-pin welds, had improved arc suppression performance. Three of the guns had the prior art arrangement of straight leads and unprotected welds. Four of the guns had the improved lead-to-pin arrangement described herein. Each of the electron guns was placed in a glass neck having a thin transparent interior coating of tin oxide. A high electric field was applied between each electron gun and the neck so that all of the electron guns would produce field emission at some point on each gun. Field emission to the glass neck resulted in a blue fluorescence at the point of impact, which made it possible to identify the source of the emission. Also, the currents to the various leads were monitored, to further verify the source of emission. The following tables give the results of these tests and include the applied voltage, to further characterize each gun. Table I presents the results for the three electron guns having the prior art lead-to-pin attachments, and Table II presents the results for the electron guns having the improved lead-to-pin attachment.

TABLE I

TABLE I

| Gun No. | Voltage kV | Current μA | Source of Emission |
|---|---|---|---|
| 1 | 6.5 | 2 | G1 lead-to-pin weld |
| 2 | 7.5 | 2 | G1 lead-to-pin weld |
| 2 | 8.5 | 2 | Weld splatter on outer cathode terminal |
| 3 | 5.5 | 2 | G2 lead-to-pin weld |

TABLE I-continued

| Gun No. | Voltage kV | Current μA | Source of Emission |
|---|---|---|---|
| 3 | 6.5 | 0.2 | G1 lead-to-pin weld |

TABLE II

| Gun No. | Voltage kV | Current μA | Source of Emission |
|---|---|---|---|
| 4 | 9.5 | 2 | End of G1 lead |
| 5 | 4 | 2 | Carbonized fiber on side of G3 |
| 6 | 6.5 | 2 | Carbonized fiber on side of G3 |
| 7 | 10 | 3 | Carbonized fiber in marking ink on side of G3. |

By comparing Table II with I, it can be seen that, with the improved lead-to-pin connections, the source of field emission is shifted from the welds to the electrodes and leads. Therefore, the shielding provided by the leads in the novel embodiments does prevent the lead-to-pin welds from being sources of field emission.

What is claimed is:

1. In a cathode-ray tube having an electron gun positioned within a neck of said tube, said neck being closed at one end by a stem, said stem including a plurality of electrically conductive pins extending therethrough, said pins being interconnected to various electrodes of said electron gun by electrical leads that are welded to respective pins, the improvement comprising at least one of said leads having a bend therein positioning a nonwelded portion of the lead between a lead-to-pin weld location and a portion of the neck of said tube that is nearest said weld location.

* * * * *